US011694666B2

(12) United States Patent
Kobayashi

(10) Patent No.: US 11,694,666 B2
(45) Date of Patent: Jul. 4, 2023

(54) ELECTRONIC CYMBAL AND BELL PART SENSOR INSTALLATION METHOD

(71) Applicant: Roland Corporation, Shizuoka (JP)

(72) Inventor: Syota Kobayashi, Shizuoka (JP)

(73) Assignee: Roland Corporation, Shizuoka (JP)

( * ) Notice: Subject to any disclaimer, the term of this patent is extended or adjusted under 35 U.S.C. 154(b) by 173 days.

(21) Appl. No.: 16/942,776

(22) Filed: Jul. 30, 2020

(65) Prior Publication Data

US 2021/0035543 A1 Feb. 4, 2021

(30) Foreign Application Priority Data

Aug. 1, 2019 (JP) ..... 2019-142384

(51) Int. Cl.
*G10H 3/14* (2006.01)
*G10H 1/32* (2006.01)
*G10D 13/063* (2020.01)

(52) U.S. Cl.
CPC ..... *G10H 3/146* (2013.01); *G10D 13/063* (2020.02); *G10H 1/32* (2013.01)

(58) Field of Classification Search
CPC ..... G10H 3/146; G10H 1/32; G10D 13/063
See application file for complete search history.

(56) References Cited

U.S. PATENT DOCUMENTS 7,473,834 B2 * 1/2009 Yoshino ..... G10H 1/32 84/742
2012/0024132 A1 * 2/2012 Wallace ..... G10H 3/146 84/689
2013/0247747 A1 * 9/2013 Yamada ..... G10H 3/146 84/723
2016/0196811 A1 7/2016 Shen
2018/0204557 A1 * 7/2018 Steinhauser ..... G10D 13/063

FOREIGN PATENT DOCUMENTS

JP 2002207481 7/2002

* cited by examiner

*Primary Examiner* — Jianchun Qin
(74) *Attorney, Agent, or Firm* — JCIPRNET

(57) ABSTRACT

An electronic cymbal and a bell part sensor installation method are provided. The electronic cymbal includes: a disk-shaped frame; a frame bell part which is configured at a center of the frame in a top view; a bell part sensor which is attached onto the frame bell part in a circumferential direction and detects a hit on the frame bell part; and a cover which covers the frame and the bell part sensor and has a surface formed as a hit surface, wherein the bell part sensor is separated in at least a radial direction of the frame bell part.

19 Claims, 9 Drawing Sheets

ELECTRONIC CYMBAL AND BELL PART SENSOR INSTALLATION METHOD

CROSS-REFERENCE TO RELATED APPLICATION

This application claims the priority of Japanese patent application No. 2019-142384, filed on Aug. 1, 2019. The entirety of the above-mentioned patent application is hereby incorporated by reference herein and made a part of this specification.

BACKGROUND

Technical Field

The present disclosure relates to an electronic cymbal and a bell part sensor installation method.

Description of Related Art

Patent Document 1 discloses an electronic cymbal in which a conical bell part is formed in a frame 105, and a sheet-shaped bell part sensor is disposed in the bell part. Since the bell part is formed by the frame, the feeling of hitting the bell part becomes hard and can be close to the feeling of a bell part of an actual cymbal.

PATENT DOCUMENTS

[Patent Document 1] US Patent Application Publication No. 2016/0196811 (for example, Paragraphs 0057-0059, FIGS. 6 to 9, and the like)

However, a bell part sensor is provided in a radial direction of a conical bell part, and thus an originally sheet-shaped bell part sensor needs to be deformed into a conical shape and disposed. For this reason, there is a concern that a bell part sensor deformed into a conical shape may peel off from the frame, or upper and lower films of the bell part sensor itself may peel off due to a hit on the bell part or changes in temperature and humidity.

SUMMARY

An electronic cymbal is provided. The electronic cymbal includes a disk-shaped frame, a frame bell part which is configured at a center of the frame in a top view, a bell part sensor which is attached onto the frame bell part in a circumferential direction and detects a hit on the frame bell part, and a cover which covers the frame and the bell part sensor and has a surface formed as a hit surface, in which the bell part sensor is separated at least in a radial direction of the frame bell part.

A bell part sensor installation method is provided, which is a method of providing a bell part sensor in a frame bell part in an electronic cymbal. The electronic cymbal includes a disk-shaped frame, the frame bell part which is formed at a center of the frame in a top view, and the bell part sensor which is attached onto the frame bell part in a circumferential direction and detects a hit on the frame bell part. The bell part sensor installation method includes providing the bell part sensor in the frame bell part by separating the bell part sensor at least in a radial direction of the frame bell part.

DESCRIPTION OF THE EMBODIMENTS

The disclosure provides an electronic cymbal and a bell part sensor installation method which are capable of inhibiting peeling off in a bell part sensor.

Figure 1:
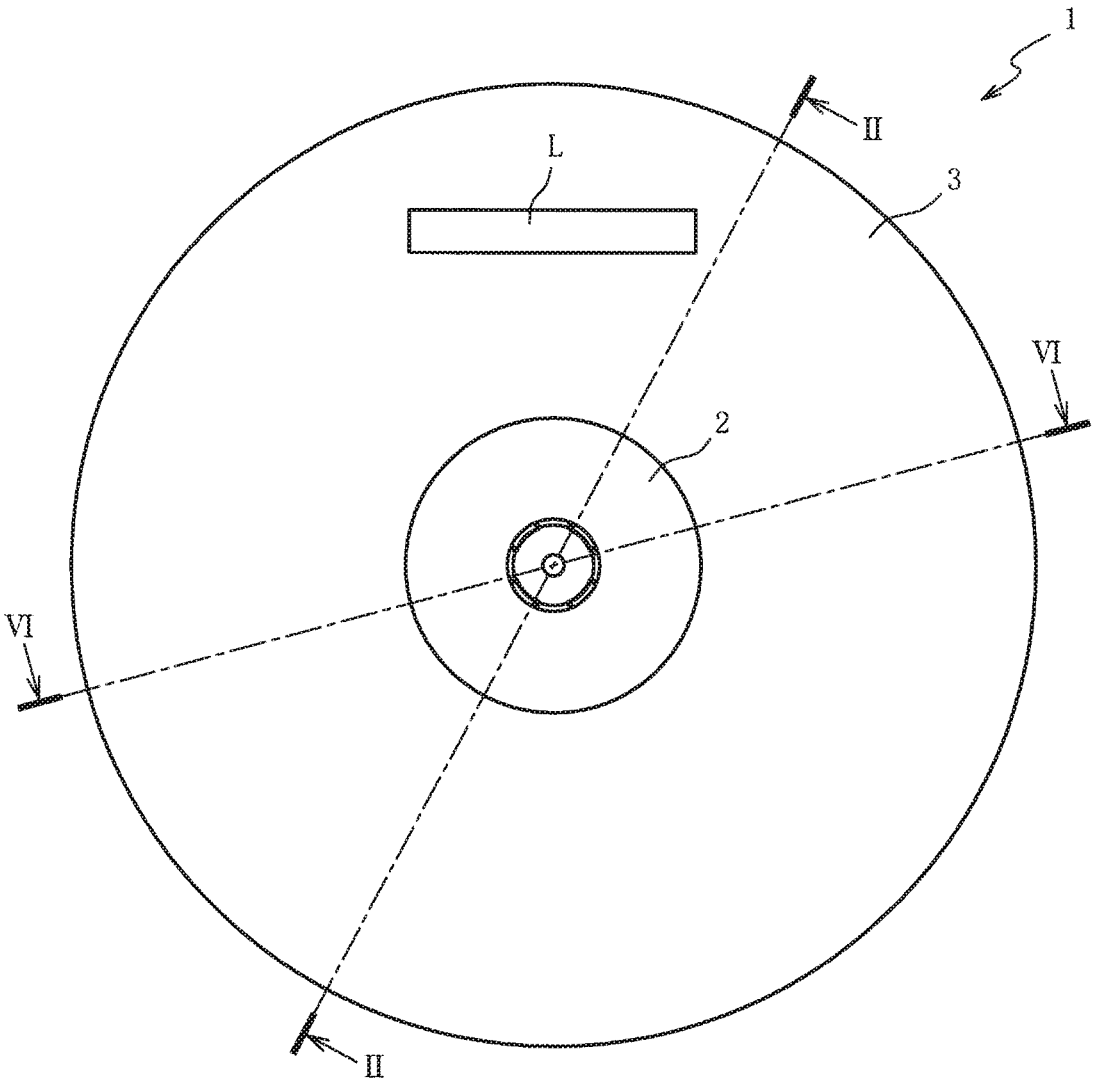
FIG. 1 is a top view of an electronic cymbal according to an embodiment.

Hereinafter, a preferred example will be described with reference to the accompanying drawings. FIG. 1 is a top view of an electronic cymbal 1 in an embodiment. The electronic cymbal 1 is an electronic percussion instrument imitating a cymbal, and includes a bell part 2 having a circular shape in a top view and provided at the central part thereof and a bow part 3 provided outside the bell part 2. A logo L stating a manufacturer name, a product name, and the like is formed in the bow part 3, and a player performs by hitting the vicinity of a side opposite to the logo L based on the bell part 2 on an upper surface of the bow part 3.

Figure 2:
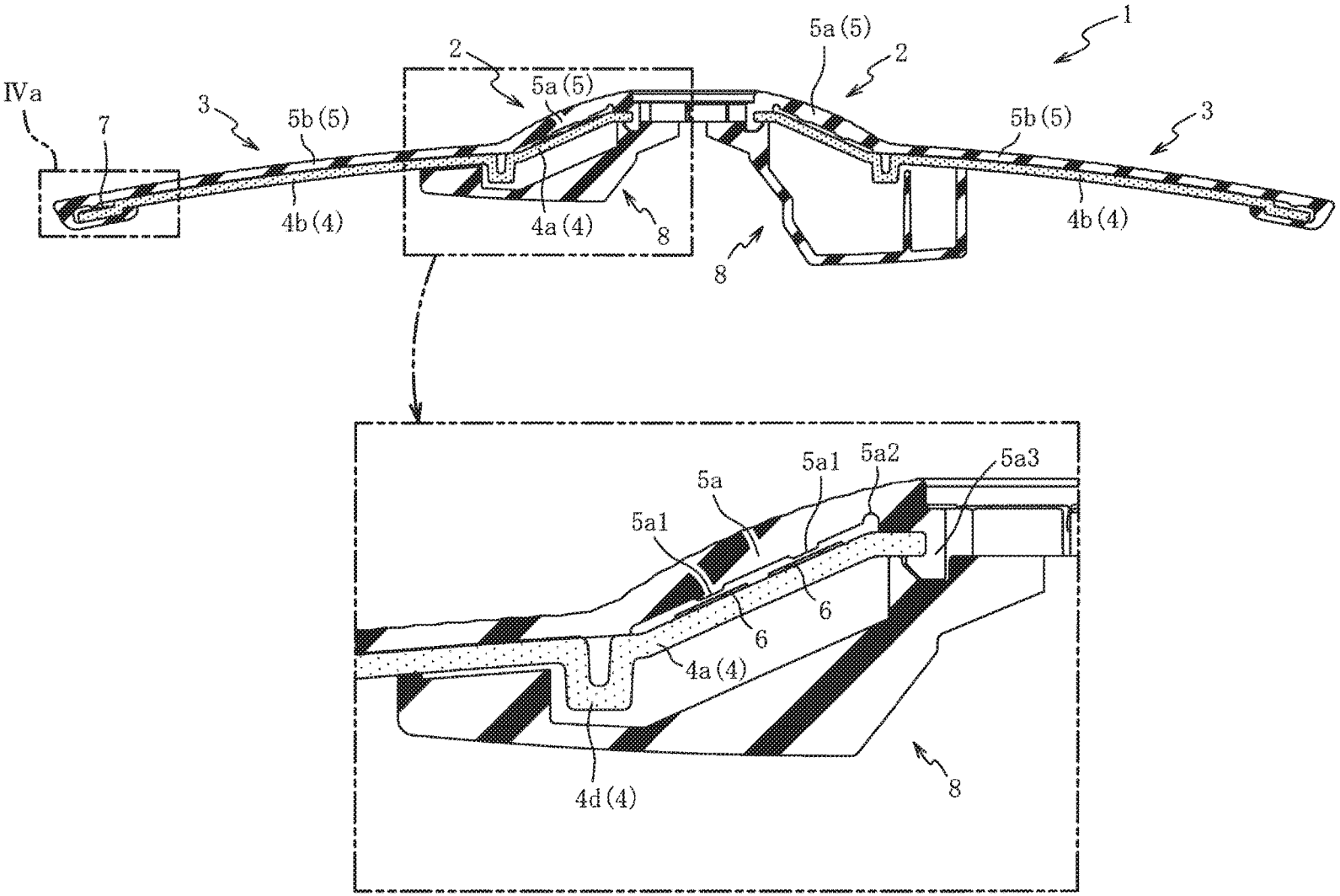
FIG. 2 is a cross-sectional view of the electronic cymbal taken along a section line II-II in FIG. 1.

When the bell part 2 is hit using a stick or the like by the player, the hit on the bell part 2 is detected by a bell part sensor 6 to be described later in FIG. 2. When the bow part 3 is hit, the hit on the upper surface of the bow part 3 is detected by a hit sensor (not shown). In addition, when an outer edge (edge) portion of the bow part 3 is hit, the hit is detected by an edge part sensor 7 to be described later in FIG. 4. That is, a hit detection device in the electronic percussion instrument is constituted by these sensors (attachment structures of the sensors to be described later). The hits detected by the bell part sensor 6, the hit sensor, and the edge part sensor 7 are converted into electrical signals and input to a sound source device not shown in the drawing, and thus sound sources based on the hits on the bell part 2 and the bow part 3 are generated.

The structure of the electronic cymbal 1 will be described with reference to FIGS. 2 to 7. First, an attachment structure of the bell part sensor 6 will be described. FIG. 2 is a cross-sectional view of the electronic cymbal 1 taken along a section line II-II in FIG. 1. As shown in FIG. 2, the electronic cymbal 1 includes a frame 4 made of reinforced plastic forming a framework, a cover 5, the bell part sensor 6 and the edge part sensor 7 provided on the upper surface of the frame 4, and a case 8 provided on the bottom surface of the frame 4 and made of synthetic rubber for protecting electronic components of the electronic cymbal 1.

A frame bell part 4*a* is formed at a position corresponding to the bell part 2 in the frame 4, and a frame bow part 4*b* is formed at a position corresponding to the bow part 3 in the frame 4. The frame bow part 4*b* is a part constituting an outer circumferential side of the frame bell part 4*a* in the frame 4 and is connected to the outer edge of the frame bell part 4*a* through a regulation part 4*d* to be described later (see an enlarged portion in FIG. 2). The frame bell part 4*a* is formed such that the side surface thereof has a conical shape which is tapered upward, and the bell part sensor 6 detecting a hit on the bell part 2 is attached to the side surface of the frame bell part 4*a* using double-sided tape.

The bell part sensor 6 is formed in a sheet shape by vertically attaching a polyethylene terephthalate (PET) film having conductive paste applied thereto so that the conductive pastes face each other. In a case where the bell part sensor 6 is pressed due to a hit or the like and the upper and lower conductive pastes come into contact with each other, an electrical signal is output from the bell part sensor 6.

Since the frame bell part 4*a* is formed such that the side surface thereof has a conical shape, the shape of the side surface in the cross-section of the frame bell part 4*a* has a linear shape. The sheet-shaped bell part sensor 6 is attached to such a frame bell part 4*a*, so that the bell part sensor 6 and the frame bell part 4*a* can be brought into close contact with each other in a radial direction.

The cover 5 is a member made of synthetic rubber that covers the upper portion of the frame 4 and forms a hit surface of the electronic cymbal 1. The cover 5 is attached to the frame 4 using double-sided tape, and specifically, a portion corresponding to the bow part 3 (see FIG. 1) on the upper surface of the frame 4 and a position corresponding to the bow part 3 (see FIG. 1) of the cover 5 are attached to each other using the double-sided tape.

A cover bell part 5*a* covering the frame bell part 4*a* and the bell part sensor 6 are formed at a position corresponding to the bell part 2 in the cover 5, and a cover bow part 5*b* covering the frame bow part 4*b* and the edge part sensor 7 is formed at a position corresponding to the bow part 3 in the cover 5. The cover bell part 5*a* is formed such that the surface thereof, that is, a surface hit by a stick or the like has a hemispherical shape (bowl shape) which is convex upward. Thereby, the surface of the cover bell part 5*a*, that is, the surface of the bell part 2 can be formed into a shape conforming to the shape of a bell part in an actual cymbal.

A projection part 5*a*1 having a projection shape is formed on the rear surface of the cover bell part 5*a*, that is, a surface facing the frame bell part 4*a* and the bell part sensor 6 and facing the bell part sensor 6. A surface (facing surface) facing the bell part sensor 6 in the projection part 5*a*1 is formed in a conical shape so as to conform to the shape of the frame bell part 4*a* at a position where the bell part sensor 6 is provided. In addition, the projection part 5*a*1 is formed such that the facing surface of the projection part 5*a*1 faces and is parallel to the bell part sensor 6. In addition, the projection part 5*a*1 is formed such that a gap is provided between the facing surface of the projection part 5*a*1 and the upper surface of the bell part sensor 6, and the size of the gap is set to 0.3 mm to 0.8 mm.

In a case where the cover bell part 5*a* is hit, the cover bell part 5*a* is bent, and a gap between the projection part 5*a*1 and the bell part sensor 6 is eliminated. Thereby, the bell part sensor 6 is pressed against the projection part 5*a*1, and a hit is transmitted to the bell part sensor 6. In this case, since the facing surface of the projection part 5*a*1 is formed to conform to the shape of the frame bell part 4*a* at a position where the bell part sensor 6 is provided, and the facing surface of the projection part 5*a*1 and the bell part sensor 6 are further formed to face and be parallel to each other, the bell part sensor 6 is pressed against the parallel surfaces of the projection part 5*a*1 and the frame bell part 4*a*. Thereby, the upper and lower conductive pastes of the bell part sensor 6 are pressed parallel against each other from above and below, and thus a hit on the cover bell part 5*a* can be appropriately transmitted to the bell part sensor 6.

A gap is formed between the facing surface of the projection part 5*a*1 and the bell part sensor 6, and thus the projection part 5*a*1 is prevented from coming into contact with the bell part sensor 6 in a case where a portion other than the cover bell part 5*a*, for example, the bow part 3 is hit. Thereby, it is possible to curb erroneous detection of the bell part sensor 6 in a case where a portion other than the cover bell part 5*a* is hit.

Further, a gap between the facing surface of the projection part 5*a*1 and the bell part sensor 6 is set to 0.3 mm to 0.8 mm. Thereby, even when a hit on the cover bell part 5*a* is weak (that is, the strength of the hit is low), the projection part 5*a*1 can be pushed into the bell part sensor 6, and thus the sensitivity of a hit with respect to a weak hit can be improved.

In the cover bell part 5*a*, a recess 5*a*2 having a U shape in a cross-sectional view is formed at a position on the inner circumferential side of the projection part 5*a*1 on the inner circumferential side. The recess 5*a*2 is deformed due to a hit on the cover bell part 5*a*, and thus the degree of bending of the cover bell part 5*a* can be increased. Thereby, even when a hit on the cover bell part 5*a* is weak, the degree of bending of the cover bell part 5*a* is increased, and thus the hit can be appropriately transmitted to the bell part sensor 6.

In addition, the cover bell part 5*a* is formed to have such a thickness that the thickness of a portion in which the thickest projection part 5*a*1 is formed is equal to or less than twice the thickness of a portion in which the thinnest recess 5*a*2 is formed. Thereby, an increase in thickness is curbed in the cover bell part 5*a*, and thus it is possible to suppress elastic deformation of the cover bell part 5*a* with respect to a hit on the cover bell part 5*a*. Thereby, a feeling of hitting the cover bell part 5*a* (a sense of hitting) can be made as hard as in an actual cymbal.

An engagement part 5*a*3 for engaging the cover 5 with the frame 4 by hooking the inner circumferential side of the frame bell part 4*a* is formed on the inner circumferential side of the cover bell part 5*a*. The engagement part 5*a*3 is formed at four locations on the inner circumferential side of the cover bell part 5*a* (not shown), and the engagement part 5*a*3 is formed such that the engagement part 5*a*3 comes into contact with the upper surface, the bottom surface, and the side surface of the frame bell part 4*a* in a case where the engagement part 5*a*3 is hooked on the inner circumferential side of the frame bell part 4*a*.

As described above, a portion corresponding to the bow part 3 (see FIG. 1) on the upper surface of the frame 4 and a position corresponding to the bow part 3 of the cover 5 are attached to each other using a double-sided tape. In this case, first, the bell part sensor 6 is disposed on the frame bell part 4*a*, the engagement part 5*a*3 is hooked on the inner peripheral side of the frame bell part 4*a*, and position adjustment is performed so that the projection part 5*a*1 is positioned on the bell part sensor 6.

Thereafter, portions of the frame 4 and the cover 5 which correspond to the bow part 3 are attached in order from the inner circumferential side of the cover 5 to the outer circumferential side. Here, the cover 5 engages with the inner circumferential side of the frame bell part 4*a* due to the engagement part 5*a*3, and thus the movement of the cover 5 in an outer circumferential direction is restricted. Thereby, it is possible to attach the frame 4 and the cover 5 to each other while maintaining a positional relationship between the projection part 5*a*1 and the bell part sensor 6.

Figure 3A:
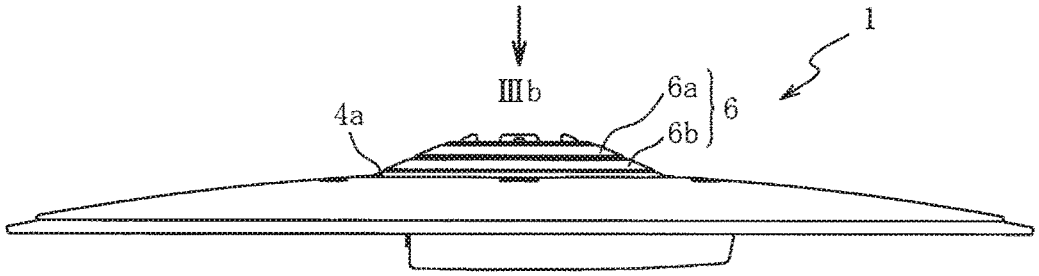
FIG. 3(A) is a side view of the electronic cymbal in which a cover is omitted.
Figure 3B:
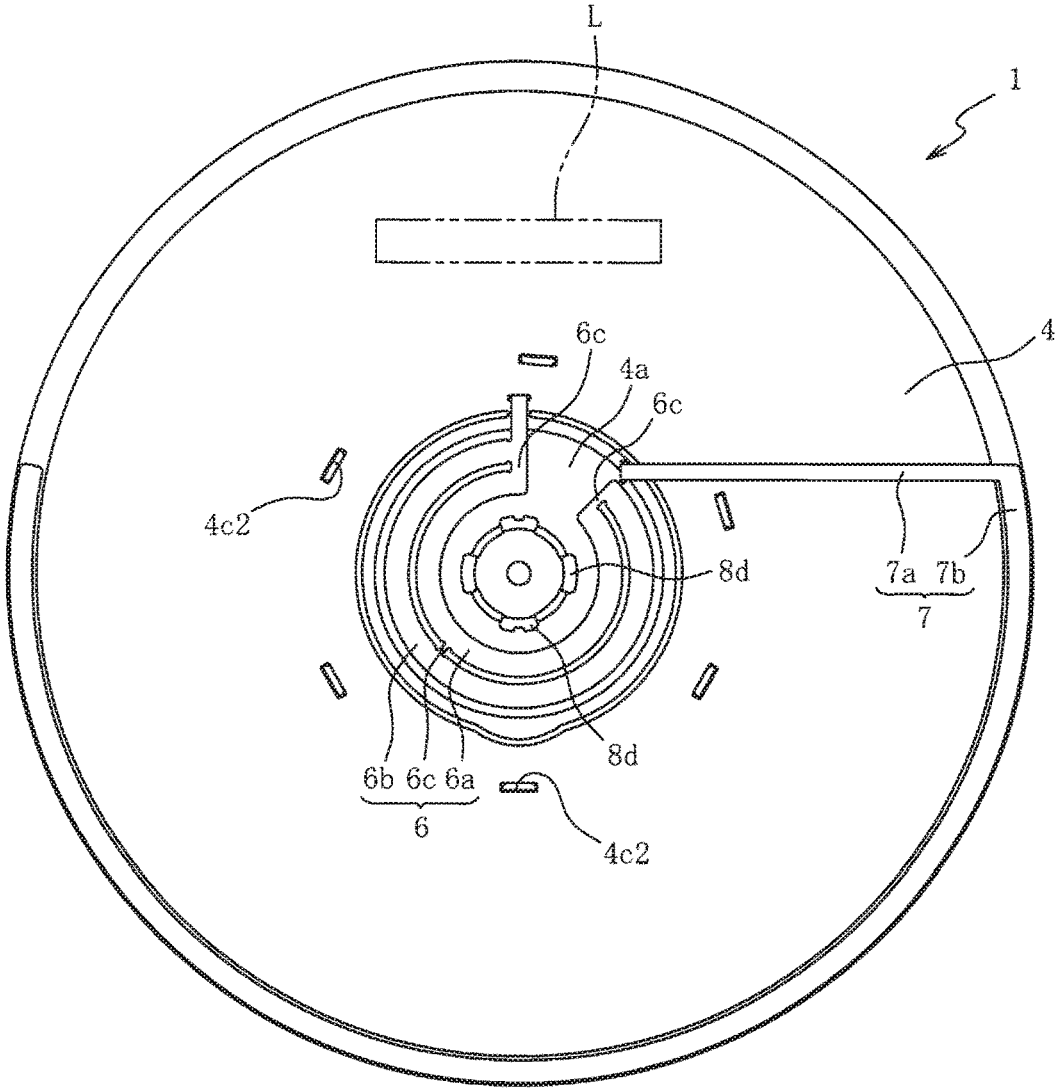
FIG. 3(B) is a top view of the electronic cymbal in which the cover is omitted.

Next, the shapes of the bell part sensor 6 and the edge part sensor 7 will be described with reference to FIG. 3. FIG. 3(A) is a side view of the electronic cymbal 1 in which the cover 5 is omitted, and FIG. 3(B) is a top view of the electronic cymbal 1 in which the cover 5 is omitted. Meanwhile, for simplification of the illustration of the drawing, the edge part sensor 7 (see FIG. 3(B)) is not shown in FIG. 3(A). As shown in FIG. 3(A), the sheet-shaped bell part sensor 6 is deformed into a conical shape and attached to the frame bell part 4*a* so that the side surface thereof conforms to the shape of the conical frame bell part 4*a*.

As shown in FIG. 3(B), the bell part sensor 6 is formed in an arc shape in a top view. The bell part sensor 6 is separated into two parts in the radial direction thereof, and specifically, an inner circumferential sensor 6*a* forming the inner circumferential side of the bell part sensor 6 and an outer circumferential sensor 6*b* forming the outer circumferential side thereof are provided. The inner circumferential sensor 6*a* and the outer circumferential sensor 6*b* are formed to have substantially the same width in the radial direction. Meanwhile, "substantially the same" means that variations in manufacturing processes, materials, and measurement are permitted. Specifically, "substantially the same" and "substantially constant" are defined as within a range of ±10%, and the same applies in the following description.

The bell part sensor 6 is separated into the inner circumferential sensor 6*a* and the outer circumferential sensor 6*b*, so that the respective widths in the radial direction are reduced. As described above, the bell part sensor 6 is bent in accordance with the shape (conical shape) of the side surface of the frame bell part 4*a* and attached, but the amount of deformation of each of the inner circumferential sensor 6*a* and the outer circumferential sensor 6*b* due to bending is smaller than that in a case where the bell part sensor 6 is formed as one sensor. Thus, a repulsive force (restoring force) of the bent inner circumferential sensor 6*a* and outer circumferential sensor 6*b* to return to the original sheet shapes is smaller than that in a case where the bell part sensor 6 is formed as one sensor.

Thereby, it is possible to prevent the inner circumferential sensor 6*a* and the outer circumferential sensor 6*b* attached to the frame bell part 4*a* from peeling off from the frame bell part 4*a*. In particular, in a case where the bell part 2 is hit and a case where temperature and humidity change greatly due to an environmental test or the like, it is possible to prevent the inner circumferential sensor 6*a* and the outer circumferential sensor 6*b* from peeling off. In addition, the amount of deformation of each of the inner circumferential sensor 6*a* and the outer circumferential sensor 6*b* is reduced in a case where the sensors are bent, so that upper and lower films having conductive paste applied thereto in the inner circumferential sensor 6*a* and the outer circumferential sensor 6*b* can also be prevented from peeling off.

In addition, as shown in FIG. 3(B), the bell part sensor 6 is formed in an arc shape (C shape) of which a portion is divided in a top view and is provided in the frame bell part 4*a* so that the divided portion in the bell part sensor 6 is positioned on the logo L side. This is because in a case where a player hits the bow part 3 strongly (see FIG. 1) on a side opposite to the logo L based on the bell part 2, the electronic cymbal 1 greatly moves up and down due to a reaction, and a support (not shown) provided at the center of the bell part 2 may come into contact with the logo L side in the bell part 2. Consequently, in the frame bell part 4*a*, the bell part sensor 6 is not formed on a side where the logo L is provided, so that it is possible to suppress erroneous detection of a hit on the bell part 2 when the support comes into contact with the bell part 2.

The bell part sensor 6 is provided with a connection part 6*c* that connects the outer circumferential side of the inner circumferential sensor 6*a* and the inner circumferential side of the outer circumferential sensor 6*b*. In the present embodiment, the connection part 6*c* is provided at three locations, that is, both ends in the circumferential direction of the inner circumferential sensor 6*a* and the outer circumferential sensor 6*b*, and a substantially intermediate position in the circumferential direction between the inner circumferential sensor 6*a* and the outer circumferential sensor 6*b*.

The outer circumferential side of the inner circumferential sensor 6*a* and the inner circumferential side of the outer circumferential sensor 6*b* are connected to each other by the connection part 6*c*, so that a positional relationship between the inner circumferential sensor 6*a* and the outer circumferential sensor 6*b* is maintained. Thereby, it is possible to improve workability and the accuracy of positioning at the time of providing the bell part sensor 6 and to suppress positional deviations of the inner circumferential sensor 6*a* and the outer circumferential sensor 6*b* in the circumferential direction in a case where hitting has occurred. In addition, the connection parts 6*c* are disposed at three locations at substantially equal intervals in the circumferential direction of the inner circumferential sensor 6*a* and the outer circumferential sensor 6*b*. Thereby, it is possible to more suitably suppress positional deviations of the inner circumferential sensor 6*a* and the outer circumferential sensor 6*b* in the circumferential direction.

As shown in FIG. 3(B), the edge part sensor 7 includes a connection part 7*a* extending from the frame bell part 4*a* to the outer circumferential side, and an edge sensor 7*b* which is connected to an outer circumferential end of the connection part 7*a*. The edge sensor 7*b* is formed in an arc shape (C shape) of which a portion is divided in a top view, and the divided portion is attached to the outer edge portion of the frame 4 in a posture of facing the logo L side. Thereby, a hit on the outer edge (edge) portion of the electronic cymbal 1 is detected by the edge sensor 7*b*. Meanwhile, the sensor structure of the edge sensor 7*b* is configured similar to the bell part sensor 6 mentioned above. Accordingly, in a case where the edge sensor 7*b* is pressed due to a hit or the like and upper and lower conductive pastes come into contact with each other, an electrical signal is output from the edge part sensor 7.

Figure 4A:
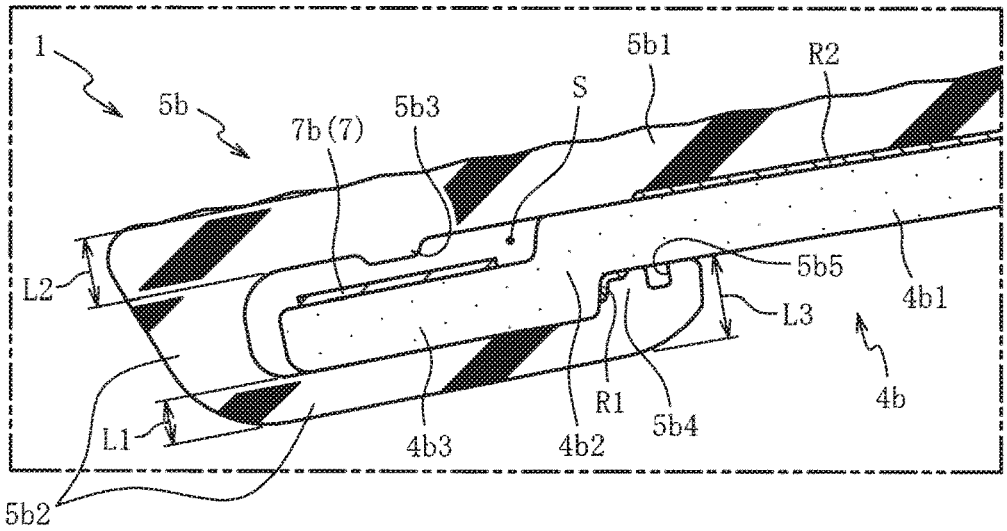
FIG. 4(A) is a partially enlarged cross-sectional view of the electronic cymbal of which a portion Iva in FIG. 2 is enlarged.
Figure 4B:
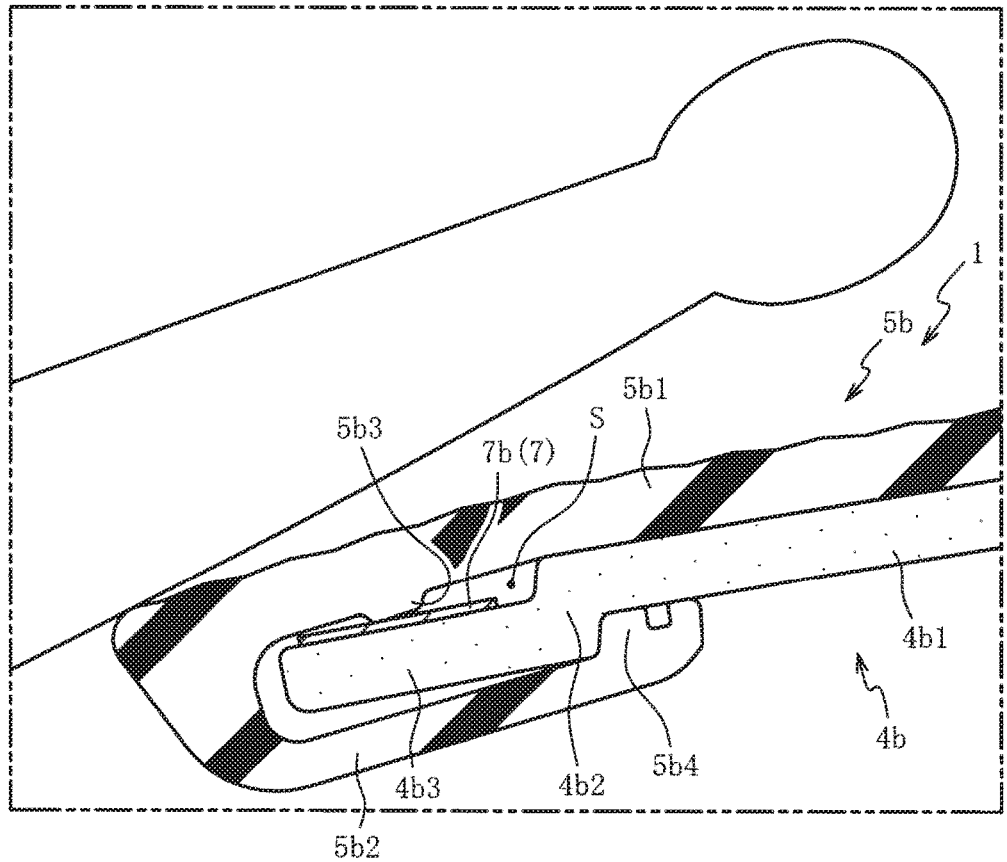
FIG. 4(B) is a partially enlarged cross-sectional view of the electronic cymbal which is hit by a stick in the state shown in FIG. 4(A).

Next, an attachment structure of the edge part sensor 7 and a method of detecting a hit will be described with reference to FIG. 4. FIG. 4(A) is a partially enlarged cross-sectional view of the electronic cymbal 1 of which a portion Iva in FIG. 2 is enlarged, and FIG. 4(B) is a partially enlarged cross-sectional view of the electronic cymbal 1 which is hit by a stick from the state shown in FIG. 4(A). Meanwhile, for simplification of the illustration of the drawing, only a cross-sectional portion of the electronic cymbal 1 is shown in FIG. 4. In addition, bonding regions R1 and R2 between the frame bow part 4*b* and the cover bow part 5*b* are exaggerated and schematically shown in FIG. 4(A), and the bonding regions R1 and R2 are not shown in FIG. 4(B).

The frame bow part 4*b* includes a main body 4*b*1 which is gently inclined downward from the outer edge of the frame bell part 4*a* (see FIG. 2) to the outer circumferential side (outside in the radial direction), a bent part 4*b*2 which is bent downward from the outer edge of the main body 4*b*1, and an outer circumferential part 4*b*3 which protrudes toward the outer circumferential side from a lower end side of the bent part 4*b*2, and is formed in a disk shape. That is, the main body 4*b*1, the bent part 4*b*2, and the outer circumferential part 4*b*3 constituting the frame bow part 4*b* are formed continuously in the circumferential direction.

The main body 4*b*1 is a part that forms a framework of a main body portion of the bow part 3 (see FIG. 2), and the outer circumferential part 4*b*3 is a part that forms a framework of an outer edge portion of the bow part 3. Thickness dimensions (plate thicknesses) of the main body 4*b*1 and the outer circumferential part 4*b*3 are set to be substantially the same, and the main body 4*b*1 and the outer circumferential part 4*b*3 are vertically connected by the bent part 4*b*2. Accordingly, the upper surface of the outer circumferential part 4*b*3 is positioned below the upper surface of the main body 4*b*1, and the lower surface of the outer circumferential part 4*b*3 is also positioned below the lower surface of the main body 4*b*1.

The edge sensor 7*b* is attached to the upper surface of the outer circumferential part 4*b*3 using a double-sided tape, and the cover bow part 5*b* covers the frame bow part 4*b* in a state where a space S capable of accommodating the edge sensor 7*b* is formed. Meanwhile, in the following description, the space S formed between the upper surface of the outer circumferential part 4*b*3 and the lower surface of the cover bow part 5*b* before hitting occurs (the state of FIG. 4(*a*)) is simply referred to as a "space S".

The cover bow part 5*b* includes an upper cover part 5*b*1 that covers the upper surface of the frame bow part 4*b* and a lower cover part 5*b*2 which is connected to the outer edge of the upper cover part 5*b*1 and covers a region from the outer edge of the frame bow part 4*b* to an edge part of the lower surface. Meanwhile, in addition to the space S, a space (connected to the space S) is also formed in a region between the lower cover part 5*b*2 and the outer circumferential surface of the outer circumferential part 4*b*3 in a state before hitting.

A projection part 5*b*3 having a projection shape protruding toward the edge sensor 7*b* is formed on the lower surface of the upper cover part 5*b*1, and a gap is formed between a tip end of the projection part 5*b*3 and the edge sensor 7*b*. Accordingly, in a case where the outer edge portion of the upper cover part 5*b*1 is hit (see FIG. 4(B)), the projection part 5*b*3 is pressed against the edge sensor 7*b* due to elastic deformation (bending) toward the space S of the upper cover part 5*b*1, and thus such a hit is detected by the edge sensor 7*b*.

A gap is formed between a tip end face of the projection part 5*b*3 and the edge sensor 7*b* in a state before hitting, and thus it is possible to prevent the projection part 5*b*3 from being pressed against the edge sensor 7*b* in a case where a portion other than the cover bow part 5*b*, for example, the bell part 2 (see FIG. 2) is hit. Thereby, in a case where a portion other than the outer edge of the cover bow part 5*b* is hit, it is possible to prevent the edge sensor 7*b* from erroneously detecting the hit.

In this manner, a configuration in which the projection part 5*b*3 is pressed against the edge sensor 7*b* due to elastic deformation of the upper cover part 5*b*1 at the time of hitting is adopted, but the lower cover part 5*b*2 is connected to the outer edge of the upper cover part 5*b*1. Accordingly, the lower cover part 5*b*2 is also elastically deformed in association with the elastic deformation of the upper cover part 5*b*1 (see FIG. 4(B)). However, in the present embodiment, the lower cover part 5*b*2 is configured to be easily elastically deformed even in a case where a hit is weak. This configuration will be described below.

A bonding part 5*b*4 that protrudes toward the lower surface of the main body 4*b*1 of the frame bow part 4*b* is formed from the inner edge (an end on the right side in FIG. 4(A)) of the lower cover part 5*b*2. The bonding part 5*b*4 is bonded from the inner circumferential surface of the bent part 4*b*2 of the frame bow part 4*b* to the lower surface of the main body 4*b*1 using an adhesive. On the other hand, an upper surface of the lower cover part 5*b*2 is not bonded to the lower surfaces of the bent part 4*b*2 and the outer circumferential part 4*b*3 on the outer circumferential side (the left side in FIG. 4(A)) of a bonding region R1 between the bonding part 5*b*4 and the frame bow part 4*b* (hereinafter, simply referred to as a "bonding region R1"). In addition, the lower surfaces of the bent part 4*b*2 and the outer circumferential part 4*b*3 and the upper surface of the lower cover part 5*b*2 are configured as flat surfaces in such a non-bonding region. Accordingly, a hook for inhibiting deformation toward the inner circumferential side (inside in the radial direction) of the lower cover part 5*b*2 is not formed between the lower surface of the frame bow part 4*b* and the upper surface of the lower cover part 5*b*2.

That is, the inner edge side of the lower cover part 5*b*2 is bonded to the lower surface of the frame bow part 4*b* through the bonding part 5*b*4 in a state where deformation toward the inner circumferential side of the lower cover part 5*b*2 and downward deformation are permitted on the lower surface side of the frame bow part 4*b*. Thereby, elastic deformation of the lower cover part 5*b*2 can be prevented from being restrained by the frame bow part 4*b*, and thus the lower cover part 5*b*2 can be easily elastically deformed when the outer edge portion of the upper cover part 5*b*1 is hit.

In addition, the bonding region R1 is positioned on the inner circumferential side (the right side in FIG. 4(A)) of the space S (edge sensor 7*b*), and thus a region in which the lower surface of the frame bow part 4*b* and the lower cover part 5*b*2 are not bonded to each other can be formed to be long in the radial direction. Thereby, a movable range of the lower cover part 5*b*2 can be expanded, and thus the lower cover part 5*b*2 can be easily elastically deformed.

Further, the lower cover part 5*b*2 is formed to have a thickness dimension (thickness) smaller than the thickness dimension of the upper cover part 5*b*1. More specifically, the lower cover part 5*b*2 in a region facing the lower surface of the outer circumferential part 4*b*3 (and the bent part 4*b*2) of the frame bow part 4*b* is formed to have a thickness dimension L1 (see FIG. 4(A)) smaller than a thickness dimension L2 of the upper cover part 5*b*1 in a region facing the upper surface (the space S) of the outer circumferential part 4*b*3. Thereby, the lower cover part 5*b*2 can be easily elastically deformed in a case where the outer edge portion of the upper cover part 5*b*1 is hit.

In this manner, the lower cover part 5b2 is made to be easily elastically deformed, so that the projection part 5b3 can be reliably pressed against the edge sensor 7b even when a hit on the upper cover part 5b1 is weak. Accordingly, it is possible to improve the accuracy of detection of a hit.

Meanwhile, in the present embodiment, the thickness dimension L1 of the lower cover part 5b2 is set to be substantially constant from an inner circumferential side to an outer circumferential side in a region facing the lower surface of the outer circumferential part 4b3 (and the bent part 4b2). With such a configuration, elastic deformation can be performed by bending the entire lower cover part 5b2, but the disclosure is not necessarily limited thereto. For example, a configuration may be adopted in which the thickness dimension of a portion of the lower cover part 5b2 is formed thin in a region facing the lower surfaces of the outer circumferential part 4b3 and the bent part 4b2, and the thin part is deformed to be bent. Thereby, it is possible to make it easier to elastically deform the lower cover part 5b2.

Here, in the present embodiment, a concave part (step) is formed in an outer edge portion on the upper surface of the frame bow part 4b, and the space S is formed by the concave part. However, as in the related art (for example, Japanese Patent Laid-Open No. 2009-145559), it is also possible to form the space S by providing a concave part (step) on the lower surface of the upper cover part 5b1.

However, when a concave part is provided on the upper cover part 5b1 side, the thickness of the upper cover part 5b1 is reduced to that extent, and thus a portion of the upper cover part 5b1 is deformed to be bent at the time of hitting, which leads to a concern that the projection part 5b3 cannot be appropriately pressed against the edge sensor 7b. When the thickness of the upper cover part 5b1 is increased in a region facing the space S in order to solve such a problem, it is also necessary to increase the thickness of the upper cover part 5b1 on the inner circumferential side of the space S in association with the increase in thickness. That is, in a configuration in which a concave part is provided on the upper cover part 5b1 side to form the space S, it is difficult to achieve both a reduction in the thickness of the cover bow part 5b and high-accuracy detection of a hit on the upper cover part 5b1.

On the other hand, in the present embodiment, the frame bow part 4b includes the bent part 4b2 which is bent downward from the outer edge of the main body 4b1 and the outer circumferential part 4b3 that protrudes toward the outer circumferential side from the lower end side of the bent part 4b2 and has the edge sensor 7b disposed on the upper surface thereof. Thereby, it is possible to form a concave part by steps of the bent part 4b2 and the outer circumferential part 4b3 and form the space S using the concave part. Accordingly, it is possible to secure the thickness of the upper cover part 5b1 in a region facing the space S while reducing the entire thickness of the cover bow part 5b, as compared to a case where a concave part is provided on the upper cover part 5b1 side to form the space S. That is, it is possible to achieve both a reduction in the thickness of the cover bow part 5b and high-accuracy detection of a hit on the upper cover part 5b1. Further, a step is formed in the cover bow part 5b by the bent part 4b2 and the outer circumferential part 4b3, and thus it is possible to increase the rigidity of the outer edge portion of the cover bow part 5b.

In addition, the bonding part 5b4 protruding toward the lower surface of the main body 4b1 is formed on the inner edge side of the lower cover part 5b2, and thus it is possible to hook the bonding part 5b4 using the step formed by the bent part 4b2 and the outer circumferential part 4b3. Thereby, displacement toward the outer circumferential side of the lower cover part 5b2 can be regulated by hooking between the inner circumferential surface of the bent part 4b2 and the bonding part 5b4, and thus a force toward the outer circumferential side can be prevented from being applied to the bonding region R1. Accordingly, it is possible to inhibit peeling off of adhesion in the bonding region R1.

On the other hand, a force toward the inner circumferential side is applied to the bonding region R1 when hitting on the upper cover part 5b1 has occurred, but the present embodiment adopts a configuration in which the force can also be reduced. That is, the thickness dimension L1 of the lower cover part 5b2 in a region facing the lower surface of the outer circumferential part 4b3 (and the bent part 4b2) is smaller than a thickness dimension L3 of the bonding part 5b4. Thereby, it is possible to make it easy to elastically deform only the lower cover part 5b2 when hitting on the upper cover part 5b1 has occurred, and thus a force toward the inner circumferential side can be prevented from being applied to the bonding region R1 at the time of hitting. Accordingly, it is possible to inhibit peeling off of adhesion in the bonding region R1.

In addition, the bonding region R1 is a connection portion between the inner circumferential surface of the bent part 4b2 and the lower surface of the main body 4b1 and is positioned above the lower end of the inner circumferential surface of the bent part 4b2. Thereby, it is possible to prevent an adhesive for bonding the bonding part 5b4 to the frame bow part 4b from flowing out between the lower surface of the outer circumferential part 4b3 and the upper surface of the lower cover part 5b2. Accordingly, it is possible to prevent a movable range of the lower cover part 5b2 from being narrowed. In addition, a concave part 5b5 recessed downward is formed on the upper surface of the bonding part 5b4 on the inner circumferential side of the bonding region R1, and thus it is possible to prevent an adhesive from flowing out to the inner circumferential side of the bonding part 5b4. Thereby, it is possible to suppress a decrease in a bonding force between the frame bow part 4b and the bonding part 5b4 and improve the appearance of the electronic cymbal 1.

Here, as described above, in order to detect a hit on the upper cover part 5b1 with a high level of accuracy, the upper cover part 5b1 is required to have a predetermined thickness in a region facing the space S. This is because it is possible to deform the entire upper cover part 5b1 so as to be bent at the time of hitting (see FIG. 4(B)). In other words, as in the related art (for example, Japanese Patent Laid-Open No. 2009-145559), when a configuration in which a portion of the upper cover part 5b1 is formed to have a small thickness in a region facing the space S is adopted, there is a concern that the thin part is deformed to be bent at the time of hitting. Accordingly, there is a concern that it is not possible to detect a hit on the upper cover part 5b1 with a high level of accuracy.

On the other hand, in the present embodiment, in a region facing the upper surface of the outer circumferential part 4b3 of the frame bow part 4b (a concave part formed by steps of the bent part 4b2 and the outer circumferential part 4b3), the thickness dimension L2 of the upper cover part 5b1 is substantially constant from the inner circumferential side to the outer circumferential side. Thereby, the entire upper cover part 5b1 can be easily deformed to be bent at the time of hitting, and thus it is possible to reliably press the projection part 5b3 against the edge sensor 7b due to the deformation of the upper cover part 5*b*1. Accordingly, it is possible to detect a hit on the upper cover part 5*b*1 with a high level of accuracy.

In addition, the upper cover part 5*b*1 is bonded to the upper surface of the frame bow part 4*b* (the main body 4*b*1) on the inner circumferential side of the outer edge of the upper surface of the bent part 4*b*2. That is, the upper cover part 5*b*1 is not bonded to the upper surface of the frame bow part 4*b* (the main body 4*b*1 and the bent part 4*b*2) on the outer circumferential side of a bonding region R2 between the upper cover part 5*b*1 and the upper surface of the frame bow part 4*b*. Thereby, the upper cover part 5*b*1 (a part which is not bonded to the upper surface of the frame bow part 4*b*) is easily deformed to extend to the outer circumferential side at the time of hitting.

Further, the thickness dimension L2 of the upper cover part 5*b*1 is substantially constant from a region which is not bonded to the upper surface of the frame bow part 4*b* to a region facing the upper surface of the outer circumferential part 4*b*3. Thereby, the upper cover part 5*b*1 is easily deformed to extend toward the outer circumferential side, for example, as compared to a case where a portion of the upper cover part 5*b*1 is formed to have a large thickness dimension. In this manner, the upper cover part 5*b*1 is made to be easily elastically deformed toward the outer circumferential side, so that it is possible to reliably press the projection part 5*b*3 against the edge sensor 7*b* even when a hit on the upper cover part 5*b*1 is weak. Accordingly, it is possible to improve the accuracy of detection of a weak hit.

In addition, the thickness dimension L2 of the upper cover part 5*b*1 is substantially constant in a region facing the upper surface of the outer circumferential part 4*b*3, and the upper surface of the outer circumferential part 4*b*3 and the lower surface (a region where the projection part 5*b*3 is not formed) of the upper cover part 5*b*1 are parallel to each other. Thereby, it is possible to make it easy to deform the entire upper cover part 5*b*1 to be bent at the time of hitting while extremely reducing a thickness dimension from the upper surface of the outer circumferential part 4*b*3 to the upper surface of the upper cover part 5*b*1.

Figure 5A:
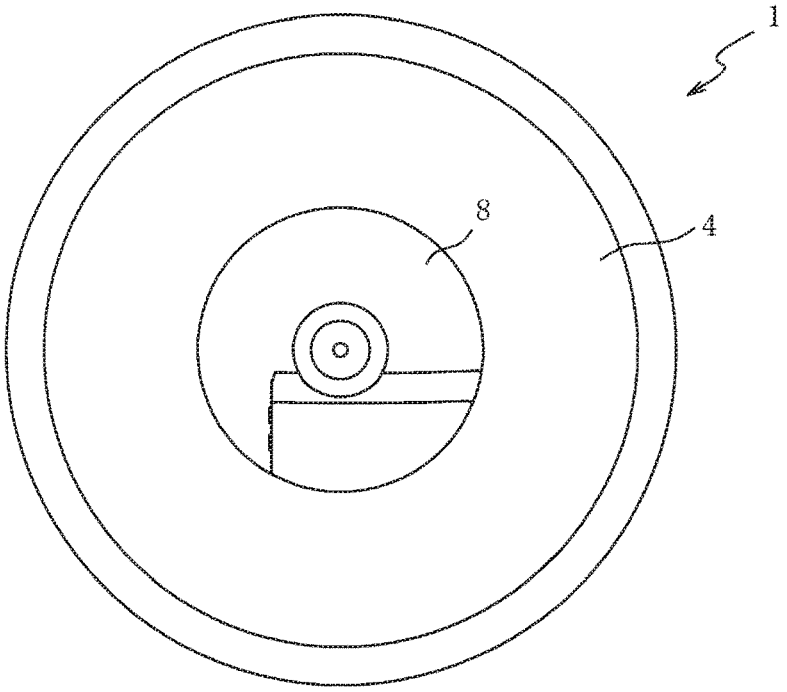
FIG. 5(A) is a bottom view of the electronic cymbal.
Figure 5B:
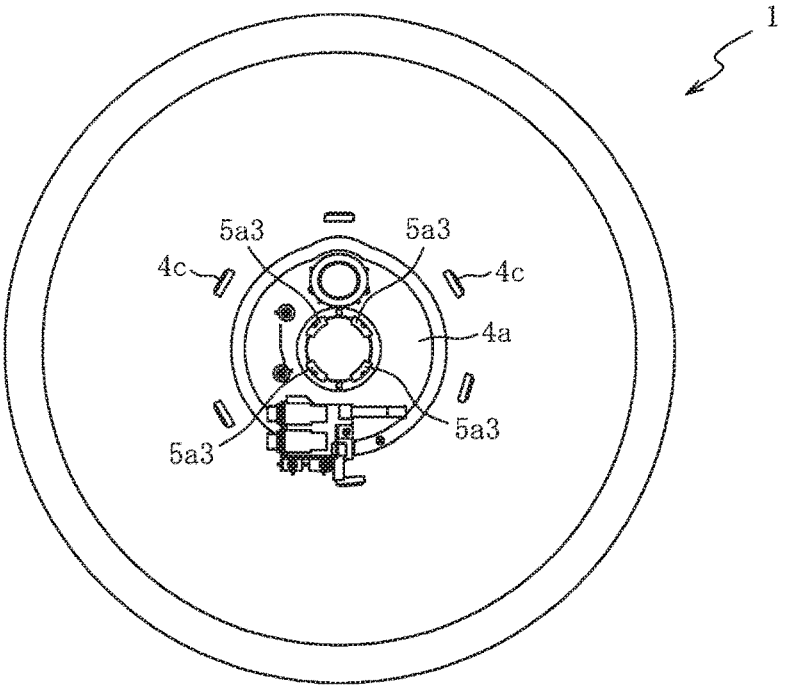
FIG. 5(B) is a bottom view of the electronic cymbal in a case where a case has been removed.

Next, the case 8 provided in the frame 4 and an attachment structure of the case 8 will be described with reference to FIGS. 5 and 6. FIG. 5(A) is a bottom view of the electronic cymbal 1, and FIG. 5(B) is a bottom view of the electronic cymbal 1 in a case where the case 8 is removed. As shown in FIG. 5(A), the case 8 is provided on the bottom surface of the frame 4.

As shown in FIG. 5(B), a frame-side attachment part 4*c* into which the case 8 is fit is formed on the bottom surface of the frame 4 and on the outside of the frame bell part 4*a*. In the present embodiment, the frame-side attachment part 4*c* is formed at six locations in the circumferential direction on the outside of the frame bell part 4*a*. The structure of the frame-side attachment part 4*c* and a fitting structure of the case 8 to the frame-side attachment part 4*c* will be described with reference to FIG. 6.

Figure 6:
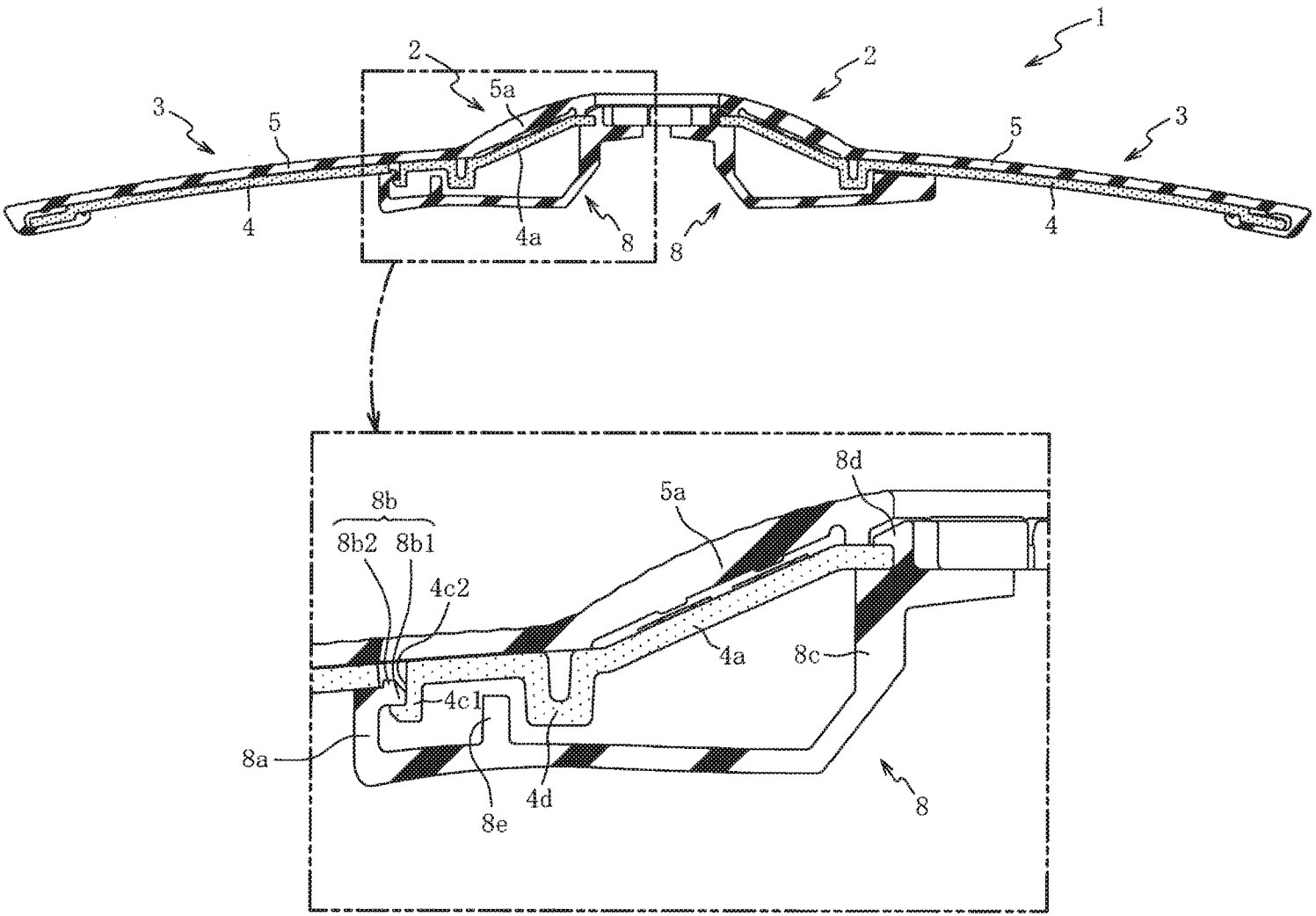
FIG. 6 is a cross-sectional view of the electronic cymbal taken along a sectional line VI-VI in FIG. 1.

FIG. 6 is a cross-sectional view of the electronic cymbal 1 taken along a section line VI-VI in FIG. 1. As shown in FIG. 6, the frame-side attachment part 4*c* includes a support part 4*c*1 and a projection accommodation part 4*c*2. The support part 4*c*1 is a part which is provided on the bottom surface of the frame 4 and formed in an L shape in a cross-sectional view. An L-shaped open part in the support part 4*c*1 is formed toward the outer circumferential side of the frame 4.

The projection accommodation part 4*c*2 is a hole which is provided adjacent to the outer circumferential side of the support part 4*c*1 and formed to penetrate the frame 4. An end of the projection accommodation part 4*c*2 on the outer circumferential side in the frame 4 is formed outside an end of the support part 4*c*1 on the outer circumferential side in the frame 4.

A hooking part 8*b* which is a part to which such a frame-side attachment part 4*c* is fit is formed in a wall-shaped case outer wall 8*a* forming the outer circumferential side of the case 8. The hooking part 8*b* is provided in an upper portion of the side surface on the inner circumferential side of the case outer wall 8*a* and formed in an arrow shape in a cross-sectional view. Specifically, a tapered tip end part 8*b*1 is formed on the inner circumferential side of the hooking part 8*b* (the right side of the paper in FIG. 6), and a protrusion part 8*b*2 protruding upward (the frame 4 side) is formed on the outer circumferential side (the left side of the paper in FIG. 6) of the tip end part 8*b*1. In addition, the bottom surface of the hooking part 8*b* and the upper surface of the protrusion part 8*b*2 are formed to respectively have lengths larger than the lengths of the upper surface of the support part 4*c*1 of the frame-side attachment part 4*c* and the bottom surface of the frame 4.

Fitting between the frame-side attachment part 4*c* and the hooking part 8*b* will be described. First, the hooking part 8*b* is inserted between the support part 4*c*1 and the projection accommodation part 4*c*2 of the frame-side attachment part 4*c*. In this case, the tip end part 8*b*1 of the hooking part 8*b* is formed to be tapered, and thus the hooking part 8*b* can be smoothly inserted between the support part 4*c*1 and the projection accommodation part 4*c*2. Here, the bottom surface of the hooking part 8*b* and a portion protruding upward are formed to respectively have lengths larger than the lengths of the support part 4*c*1 and the bottom surface of the frame 4. However, in a case where the hooking part 8*b* is inserted between the support part 4*c*1 and the projection accommodation part 4*c*2, the protrusion part 8*b*2 made of synthetic rubber is elastically deformed between the upper surface of the support part 4*c*1 and the bottom surface of the frame 4, so that the hooking part 8*b* can be inserted between the support part 4*c*1 and the projection accommodation part 4*c*2.

Further, when the tip end part 8*b*1 is inserted until the tip end part comes into contact with the support part 4*c*1, the protrusion part 8*b*2 is fitted into the projection accommodation part 4*c*2. Thereby, the hooking part 8*b* is fitted into the frame-side attachment part 4*c*. The hooking part 8*b* is fitted into the frame-side attachment part 4*c* in this manner, so that the movement of the case 8 in the inner circumferential direction can be regulated by the tip end part 8*b*1 coming into contact with the support part 4*c*1. In addition, the downward movement of the case 8 can be regulated by the bottom surface of the hooking part 8*b* coming into contact with the upper surface of the support part 4*c*1. Thereby, the hooking part 8*b* can be prevented from separating from the frame-side attachment part 4*c*, and thus it is possible to prevent the case outer wall 8*a* from separating from the frame 4.

Next, a fitting structure to the frame bell part 4*a* on the inner circumferential side of the case 8 will be described. As shown in FIG. 6, a containing part 8*d* containing the inner circumferential side of the frame bell part 4*a* is formed in an upper portion of a wall-shaped case inner wall 8*c* forming the inner circumferential side of the case 8. In a case where the containing part 8*d* is hooked on the inner circumferential side of the frame bell part 4*a*, the containing part 8*d* is formed to come into contact with an upper surface, a bottom surface, and a side surface on the inner circumferential side of the frame bell part 4*a*. In addition, the containing part 8*d* is formed at four locations in the upper portion of the case inner wall 8*c*.

The inner circumferential side of the frame bell part 4*a* is contained by the containing part 8*d*, so that the case inner wall 8*c* is fitted into the frame bell part 4*a*. Since the side surface on the inner circumferential side of the frame bell part 4*a* comes into contact with the containing part 8*d*, the movement of the case 8 in the outer circumferential direction can be regulated. In addition, the upper surface and the bottom surface on the inner circumferential side of the frame bell part 4*a* also come into contact with the containing part 8*d*, and thus the movement of the case 8 in a vertical direction can be regulated. Thereby, the containing part 8*d* can be prevented from separating from the inner circumferential side of the frame 4, and thus it is possible to prevent the case inner wall 8*c* from separating from the frame 4.

Incidentally, each of the containing part 8*d* for fitting the inner circumferential side of the case 8 and the engagement part 5*a*3 for engagement of the cover 5 is provided at four locations on the inner circumferential side of the frame 4. The containing part 8*d* and the engagement part 5*a*3 are formed so as not to interfere with each other on the inner circumferential side of the frame 4, and the containing part 8*d* and the engagement part 5*a*3 are formed to be alternately provided in a circumferential direction on the inner circumferential side of the frame 4.

As described above, the case 8 is attached to the frame 4 by fitting the hooking part 8*b* on the outer circumferential side of the case 8 into the frame-side attachment part 4*c* and fitting the containing part 8*d* on the inner circumferential side of the frame 4. A screw hole is formed in the frame 4, and the case 8 and the frame 4 are not required to be screwed. Therefore, it is possible to prevent stress from concentrating on a specific position of the frame 4 by screwing, and thus the distribution of sensitivity of a hit on the frame 4 can be made uniform.

In addition, the case 8 is fitted into the frame 4 at two locations of the case 8, that is, the inner circumferential side and the outer circumferential side. In this case, the movement of the case 8 in the inner circumferential direction is regulated by the frame-side attachment part 4*c* and the hooking part 8*b*, and the movement of the case 8 in the outer circumferential direction is regulated by the containing part 8*d*. Thereby, the movement of the case 8 in the inner circumferential direction and the outer circumferential direction can be regulated, and thus the case 8 can be reliably and firmly attached to the frame 4.

The case 8 and the frame 4 are further provided with a structure that regulates the movement of the case 8 in the circumferential direction and the vertical direction, in addition to the frame-side attachment part 4*c*, the hooking part 8*b*, and the containing part 8*d*. Specifically, a support column 8*e* having a convex shape is provided upward from the bottom surface of the case 8. The support column 8*e* is formed on the inner circumferential side (the right side of the paper in FIG. 6) of the case outer wall 8*a* and formed on the inner circumferential side of the support part 4*c*1 of the frame 4 in a case where the case 8 is attached to the frame 4. In addition, the support column 8*e* in the vertical direction is set to have such a length that a gap is formed between the upper surface of the support column 8*e* and the bottom surface of the frame 4 in a case where the case 8 is attached to the frame 4.

On the other hand, the regulation part 4*d* having a convex shape is provided on the bottom surface of the frame 4 and provided on the inner circumferential side of the support column 8*e* in a case where the case 8 is attached to the frame 4. In addition, the support column 8*e* of the case 8 is formed on the entire circumference in the circumferential direction of the case 8, and the regulation part 4*d* is also formed on the entire circumference in the circumferential direction of the frame 4.

In a case where the case 8 moves in the inner circumferential direction, the support column 8*e* comes into contact with the regulation part 4*d*, so that the movement of the case in the inner circumferential direction is regulated. On the other hand, in a case where the case 8 greatly moves in the outer circumferential direction, the support column 8*e* comes into contact with the support part 4*c*1, so that the movement of the case in the outer circumferential direction is regulated. Accordingly, positional deviations of the frame 4 and the case 8 in a radial direction can be suppressed, and thus fitting between the frame 4 and the case 8 can be appropriately maintained.

Further, in a case where the case 8 is attached to the frame 4, a gap is formed between the upper surface of the support column 8*e* and the bottom surface of the frame 4. Thereby, contact points (that is, restraint points) between the frame 4 and the case 8 can be reduced, and thus it is possible to prevent the vibration of the frame 4 from sneaking into the case 8 due to a hit and prevent the vibration of the frame 4 from attenuating. On the other hand, in a case where an external force is applied from the bottom surface side of the case 8, a gap between the support column 8*e* and the frame 4 is eliminated, and the upper surface of the support column 8*e* and the bottom surface of the frame 4 are in contact with each other, whereby it is possible to support the bottom surface side of the case 8 by the support column 8*e*. Thereby, it is possible to suppress the deformation of the case 8.

In addition, the support part 4*c*1 is a part which is fitted to the hooking part 8*b* and is also a part that comes into contact with the outer circumferential side of the support column 8*e*. Thereby, it is not necessary to separately form a part fitted to the hooking part 8*b* and a part coming into contact with the outer circumferential side of the regulation part 4*d* by forming one support part 4*c*1, and thus it is possible to reduce manufacturing costs of the frame 4 and form the bottom surface of the frame 4 in a more simple shape. Therefore, it is possible to improve propagation performance of vibration to the frame 4 due to a hit.

Figure 7A:
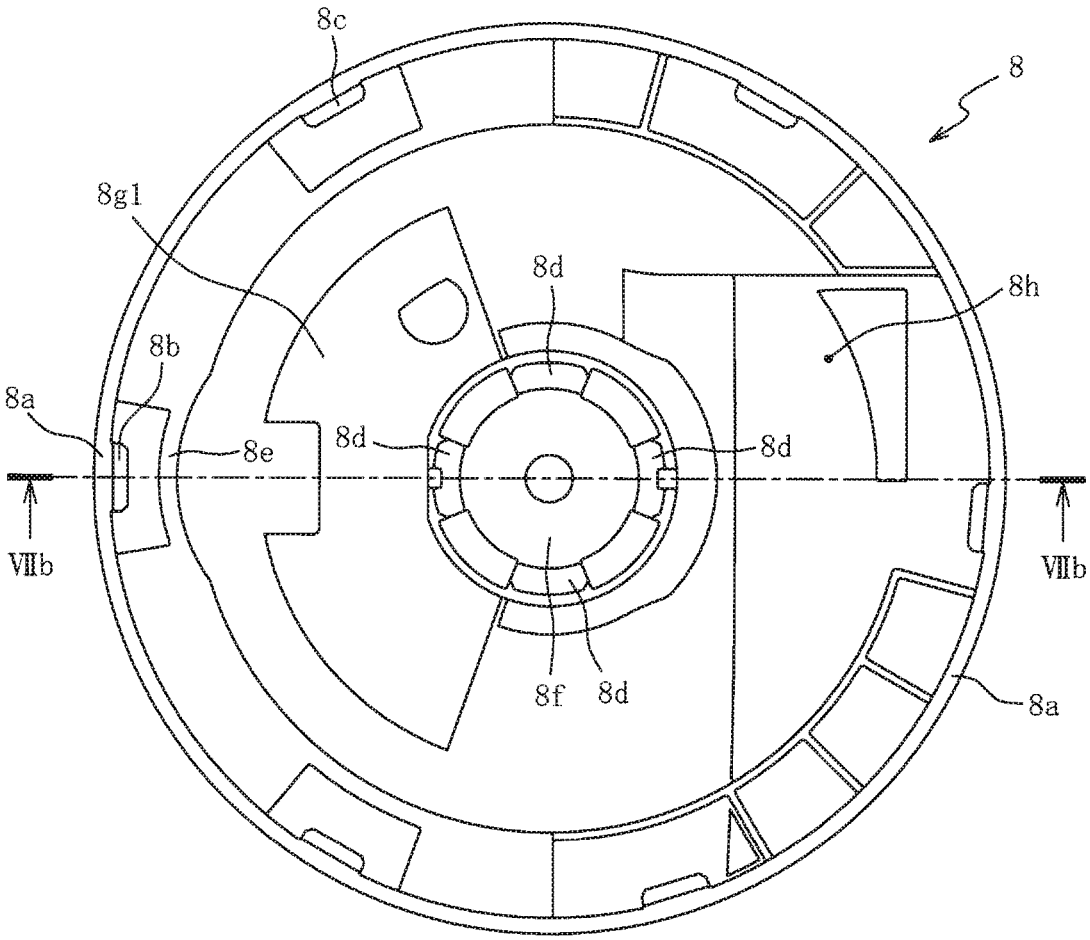
FIG. 7(A) is a top view of the case.
Figure 7B:
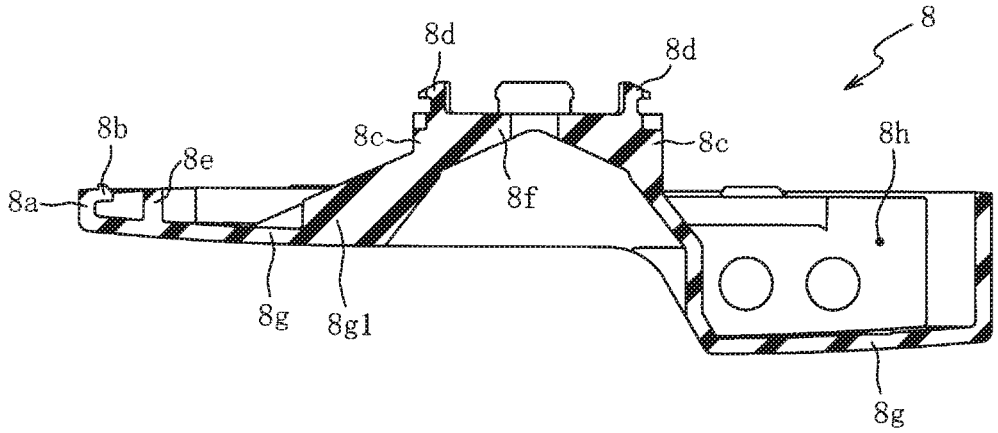
FIG. 7(B) is a cross-sectional view of the case taken along a section line VIIb-VIIb in FIG. 7(A).

Next, the shape of the case 8 will be described with reference to FIG. 7. FIG. 7(A) is a top view of the case 8, and FIG. 7(B) is a cross-sectional view of the case 8 taken along a section line VIIb-VIIb. As shown in FIG. 7, the case 8 is provided with a support attachment part 8*f*, a case bottom wall 8*g*, and a protection part 8*h*, in addition to the case outer wall 8*a*, the hooking part 8*b*, the case inner wall 8*c*, the containing part 8*d*, and the support column 8*e* described above.

The support attachment part 8*f* is a part which is formed between the case inner wall 8*c* and the case inner wall 8*c* at the center of the bottom surface of the case 8 in a top view and to which a support (not shown) supporting the electronic cymbal 1 is attached. The case bottom wall 8*g* is a wall-shaped part that forms the bottom surface of the case 8. The protection part 8*h* is formed on the case bottom wall 8*g* and is a section for protecting an electronic component (not shown) provided on the bottom surface of the frame 4.

A thick part 8*g*1 formed to have a large thickness in the case bottom wall 8*g* is formed at a position on a side facing the protection part 8*h* based on the support attachment part 8*f*. Since electronic components are provided in the frame 4, the weight balance of the frame 4 is biased toward the electronic component depending on the weight of the electronic component. Thereby, in a case where the support is attached to the support attachment part 8*f*, the electronic cymbal 1 is inclined on a side provided with the electronic component.

Consequently, the thick part 8*g*1 having a large thickness is formed on the case bottom wall 8*g* at a position on a side facing the protection part 8*h* based on the support attachment part 8*f*, so that the weight of the thick part 8*g*1 in the case 8 is increased. Thereby, a deviation of the weight balance due to the electronic component provided in the frame 4 is corrected by the weight of the thick part 8*g*1, and thus it is possible to prevent the electronic cymbal 1 from being inclined in a case where the support is attached to the support attachment part 8*f*. In addition, the thick part 8*g*1 is provided, so that it is possible to suppress the inclination of the electronic cymbal 1 without attaching a separate "weight" to the case 8 or the like.

Although description has been given above on the basis of the above-described embodiment, it is easily inferred that various improvements and changes can be made.

In the above-described embodiment, the bell part sensor 6 is divided into two sensors, that is, the inner circumferential sensor 6*a* and the outer circumferential sensor 6*b*. However, the bell part sensor 6 may be separated into two or more sensors according to the size of the bell part 2, or the like instead of being separated into two sensors. For example, as in a bell part sensor 60 shown in FIG. 8(A) and a bell part sensor 61 shown in FIG. 8(B), the bell part sensor may be divided into three sensors by providing an outermost circumferential sensor 6*d* in addition to the inner circumferential sensor 6*a* and the outer circumferential sensor 6*b*.

Figure 8A:
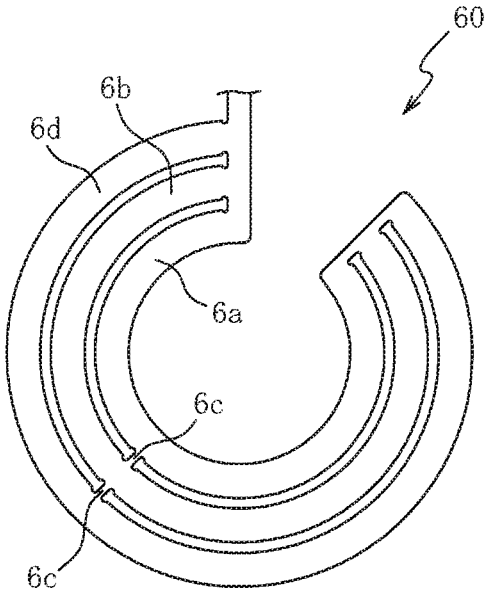
FIG. 8(A) is a top view of a bell part sensor in a modification example.
Figure 8B:
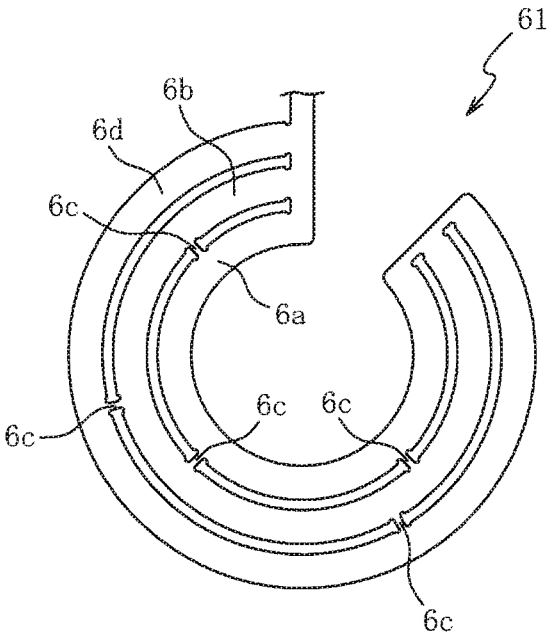
FIG. 8(B) is a top view of a bell part sensor in another modification example.

In this case, the connection part 6*c* may be provided at positions having the same phase between the inner circumferential sensor 6*a* and the outer circumferential sensor 6*b* and between the outer circumferential sensor 6*b* and the outermost circumferential sensor 6*d* as in the bell part sensor 60 shown in FIG. 8(A), or may be provided at any position between the inner circumferential sensor 6*a* and the outer circumferential sensor 6*b* and between the outer circumferential sensor 6*b* and the outermost circumferential sensor 6*d* as in the bell part sensor 61 shown in FIG. 8(B). In addition, the connection part 6*c* may be provided at four or more locations between the inner circumferential sensor 6*a* and the outer circumferential sensor 6*b* and between the outer circumferential sensor 6*b* and the outermost circumferential sensor 6*d* as in the bell part sensor 61.

In the above-described embodiment, the bell part sensor 6 is formed in an arc shape (C shape) of which a portion is divided in a top view. However, the disclosure is not necessarily limited thereto, and the bell part sensor 6 may be formed to be continuous in the circumferential direction in a top view.

Figure 8C:
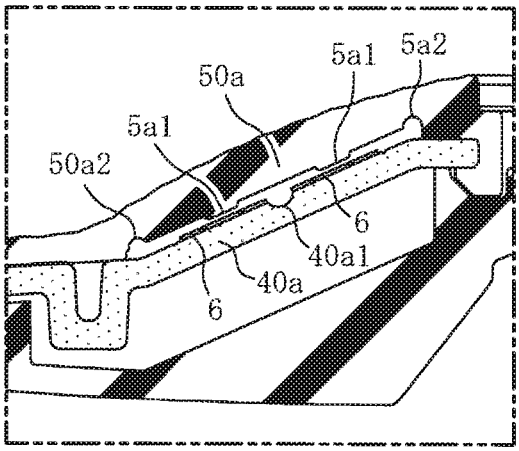
FIG. 8(C) is a cross-sectional view of an electronic cymbal showing a frame in the modification example.
Figure 8D:
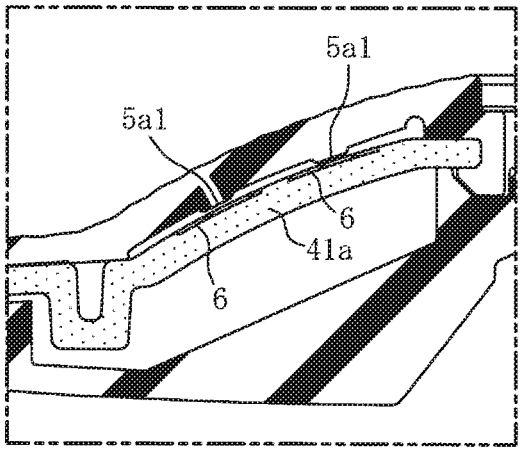
FIG. 8(D) is a cross-sectional view of an electronic cymbal showing a frame in another modification example.

In the above-described embodiment, the side surface of the frame bell part 4*a* is formed in a conical shape, thereby forming the cross-section thereof in a linear shape. However, the cross-sectional shape of the frame bell part 4*a* in a radial direction is not limited to a linear shape, any shape may be used. For example, a recess 40*a*1 may be formed between the adjacent bell part sensors 6 as in a frame bell part 40*a* shown in FIG. 8(C), or the frame bell part 41*a* may be formed in a hemispherical shape as shown in FIG. 8(D). In any case, it is preferable that a cross-sectional shape in a radial direction at a position where the bell part sensor 6 is provided in at least frame bell parts 40*a* and 41*a* is formed into a linear shape so that the bell part sensor 6 provided on the frame bell parts 40*a* and 41*a* can directly face the projection part 5*a*1 of the cover 5.

In the above-described embodiment, the recess 5*a*2 is provided at a position on the inner circumferential side rather than the projection part 5*a*1 on the inner circumferential side in the cover bell part 5*a*. However, the disclosure is not necessarily limited thereto. For example, as in the cover bell part 50*a* shown in FIG. 8(C), in addition to the recess 5*a*2, a recess 50*a*2 having a U shape in a cross-sectional view may be provided at a position on the outer circumferential side rather than the projection part 5*a*1 on the outer circumferential side in the cover bell part 5*a*. In addition, the recess 5*a*2 may be omitted, and only the recess 50*a*2 may be provided, or both the recess 5*a*2 and the recess 50*a*2 may be omitted. In addition, the shapes of the recess 5*a*2 and the recess 50*a*2 are not limited to a U shape in a cross-sectional view and may be a rectangular shape or a V shape.

Figure 9A:
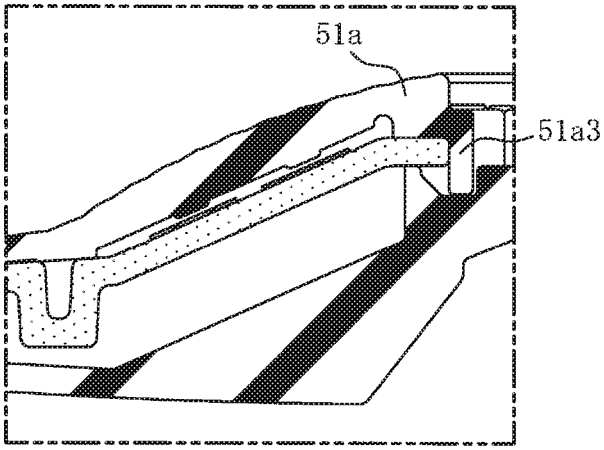
FIG. 9(A) is a cross-sectional view of the electronic cymbal showing an engagement part in the modification example.

In the above-described embodiment, in a case where the engagement part 5*a*3 is hooked on the inner circumferential side of the frame bell part 4*a*, the engagement part 5*a*3 is formed to come into contact with the upper surface, the bottom surface, and the side surface of the frame bell part 4*a*. However, the disclosure is not necessarily limited thereto. For example, as in the engagement part 51*a*3 of the cover bell part 51*a* shown in FIG. 9(A), the engagement part 51*a*3 may be formed to come into contact with the upper surface and the side surface of the frame bell part 4*a* by omitting a portion coming into contact with the bottom surface of the frame bell part 4*a*.

Figure 9B:
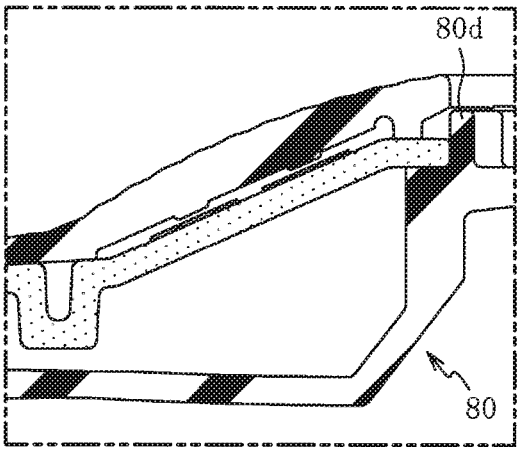
FIG. 9(B) is a cross-sectional view of the electronic cymbal showing a containing part in the modification example.

In the above-described embodiment, in a case where the containing part 8*d* is hooked on the inner circumferential side of the frame bell part 4*a*, the containing part 8*d* is formed to come into contact with the upper surface, the bottom surface, and the side surface of the frame bell part 4*a*. However, the disclosure is not necessarily limited thereto. For example, as in a containing part 80*d* of the case 80 shown in FIG. 9(B), the containing part 80*d* may be formed to engage with the upper surface and the side surface of the frame bell part 4*a* by omitting a portion coming into contact with the bottom surface of the frame bell part 4*a*.

Figure 9C:
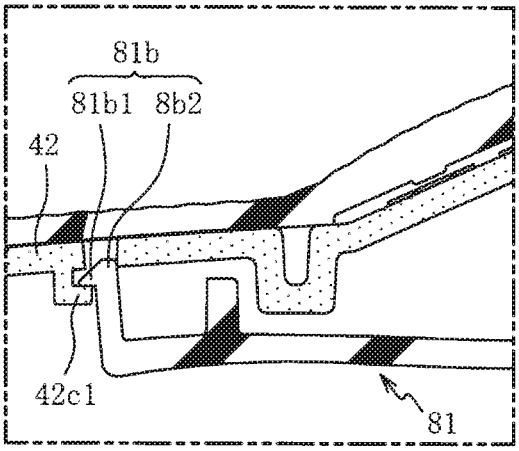
FIG. 9(C) is a cross-sectional view of the electronic cymbal showing a support part and a hooking part in the modification example.

In the above-described embodiment, the support part 4*c*1 of the frame 4 is formed in an L shape, an open portion thereof is formed toward the outer circumferential side of the frame 4, and the tip end part 8*b*1 of the hooking part 8*b* of the case 8 is formed toward the inner circumferential side of the case 8. However, the disclosure is not necessarily limited thereto. For example, as in a support part 42*c*1 of the frame 42 shown in FIG. 9(C), an open portion of the support part 42*c*1 is formed toward the inner circumferential side of the frame 4, and a tip end part 81*b*1 of a hooking part 81*b* in the case 81 may be formed toward the outer circumferential side of the case 8.

Figure 9D:
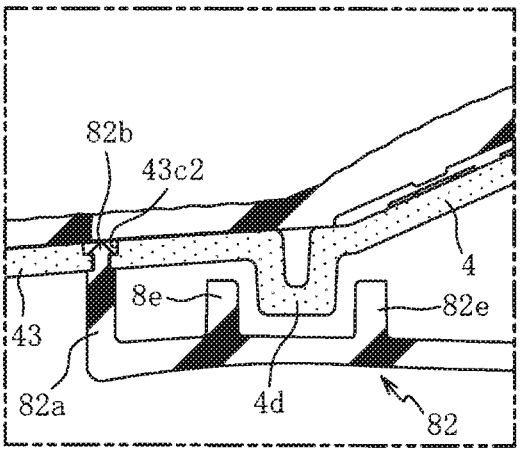
FIG. 9(D) is a cross-sectional view of the electronic cymbal showing a hooking part and a support column in another modification example.

In the above-described embodiment, the hooking part 8*b* is provided in an upper portion on the side surface of the case outer wall 8*a* on the inner circumferential side. However, a position where the hooking part 8*b* is provided is not necessarily limited thereto. For example, as in a case 82 shown in FIG. 9(D), a hooking part 82*b* may be provided on the upper surface of the case outer wall 8*a*. In this case, the hooking part 82*b* may be formed in a convex projection shape as shown in FIG. 9(D), a projection accommodation part 43*c*2 of a frame 43 may be formed in a countersunk shape, and the hooking part 82*b* may be fitted into the projection accommodation part 43*c*2. Thereby, the downward weight of the frame 43 can be supported by fitting between the hooking part 82*b* and the projection accommodation part 43*c*2, and thus it is possible to omit the support part 4*c*1 from the frame 43.

Further, in a case where the support part 4*c*1 is omitted from the frame 43, a support column 82*e* may be further provided on the outer circumferential side of the regulation part 4*d* in the case 82. Thereby, the movement of the case 8 in the outer circumferential direction which has not been regulated on the outer circumferential side of the case 82 can be regulated by the regulation part 4*d* and the support column 82*e* by omitting the support part 4*c*1. Meanwhile, it is needless to say that the support column 82*e* may be provided in the case 8 in the above-described embodiment, the case 80 in FIG. 9(B), and the case 81 in FIG. 9(C).

In the above-described embodiment, an electronic cymbal is described as an example of an electronic percussion instrument. However, the disclosure is not necessarily limited thereto, and the technical idea of the above-described embodiment (for example, a configuration in which the thickness of a cover facing a sensor is set to be substantially constant) can be naturally applied to an electronic percussion instrument simulating another musical instrument such as a cajón or a wood block. Accordingly, for example, in the above-described embodiment, a disk-shaped frame has been described as an example of a main body member serving as a framework of an electronic percussion instrument, but the disclosure is not necessarily limited thereto. For example, the main body member may be formed in a rectangular shape, a polygonal shape, or a shape obtaining by combining a curved line and a straight line with each other in a top view. In addition, a configuration may be adopted in which the thickness dimension (vertical dimension) of the main body member is larger than that of the cover 5 (for example, the main body member is formed in a box shape).

In the above-described embodiment, the frame 4 is formed of reinforced plastic. However, the disclosure is not necessarily limited thereto, and the frame 4 may be formed of any of other resin-based materials or may be formed of a metal. Further, in the above-described embodiment, the cover 5 and the case 8 are formed of synthetic rubber. However, the disclosure is not necessarily limited thereto, and the cover and the case may be formed of any of other resin-based materials such as silicon.

In the above-described embodiment, the bell part sensor 6 and the edge part sensor 7 are attached to the frame bell part 4*a* and the frame bow part 4*b* using a double-sided tape. In addition, the cover 5 is attached to the upper surface of the frame 4 using a double-sided tape, and the cover 5 (the bonding part 5*b*4) is attached to the lower surface of the frame 4 using an adhesive. However, the disclosure is not necessarily limited thereto, and the bell part sensor 6 and the edge part sensor 7 may be attached to the frame bell part 4*a* and the frame bow part 4*b* using an adhesive. In addition, the cover 5 may be attached to the upper surface of the frame 4 using an adhesive, and the cover 5 (the bonding part 5*b*4) may be attached to the lower surface of the frame 4 using a double-sided tape. That is, a method of bonding the sensors and the cover 5 to the frame 4 is not limited to adhesion, and a known bonding method (for example, the cover 5 is fused to the frame 4, or the like) can be applied as long as the sensors and the cover can be fixed to the frame 4.

In the above-described embodiment, description has been given of a case where the lower cover part 5*b*2 is not bonded to the bent part 4*b*2 of the frame bow part 4*b* and the lower surface of the outer circumferential part 4*b*3, and the lower surfaces of the bent part 4*b*2 and the outer circumferential part 4*b*3 and the upper surface of the lower cover part 5*b*2 are configured as flat surfaces in such a non-bonding region. However, the disclosure is not necessarily limited thereto, and a configuration may also be adopted in which irregularities are formed in the lower surface of the frame bow part 4*b* and the upper surface of the lower cover part 5*b*2 as long as deformation toward the inner circumferential side of the lower cover part 5*b*2 is not obstructed. Examples of such a configuration include a configuration in which a recess is formed in only the lower surface of the frame bow part 4*b* (the upper surface of the lower cover part 5*b*2) and a configuration in which minute irregularities are formed in the lower surface of the frame bow part 4*b* and the upper surface of the lower cover part 5*b*2 so that they are not caught by each other.

In the above-described embodiment, a case where the bent part 4*b*2 and the outer circumferential part 4*b*3 are formed in an outer edge of the main body 4*b*1 of the frame bow part 4*b* has been described. However, the disclosure is not necessarily limited thereto, and a configuration in which the bent part 4*b*2 and the outer circumferential part 4*b*3 are omitted, and the frame bow part 4*b* is configured as a frame that does not have a step. In this case, a concave part may be provided on the outer edge side of the lower surface of the upper cover part 5*b*1 to form the space S, the edge sensor 7*b* may be accommodated in the space S, the bonding part 5*b*4 of the inner edge portion of the lower cover part 5*b*2 may be omitted, and the lower cover part 5*b*2 may be bonded to the lower surface of the frame bow part 4*b*.

In the above-described embodiment, a case where the bonding region R1 is positioned on the inner circumferential side of the space S has been described. However, the disclosure is not necessarily limited thereto, and a configuration in which the bonding region R1 is positioned on the outer circumferential side of the space S may be adopted. That is, a configuration in which the lower cover part 5*b*2 is bonded to the bent part 4*b*2 of the frame bow part 4*b* and the lower surface of the outer circumferential part 4*b*3 may be adopted as long as the lower cover part 5*b*2 is not bonded to the outer edge side of the lower surface of the frame bow part 4*b*.

In the above-described embodiment, a case where the bonding part 5*b*4 is bonded from the inner circumferential surface of the bent part 4*b*2 of the frame bow part 4*b* to the lower surface of the main body 4*b*1 has been described. However, the disclosure is not necessarily limited thereto, and a configuration in which the bonding part 5*b*4 is bonded to only the inner circumferential surface of the bent part 4*b*2 or a configuration in which the bonding part 5*b*4 is bonded to only the lower surface of the main body 4*b*1 may be adopted.

In the above-described embodiment, a case where the thickness dimension L1 of the lower cover part 5*b*2 is formed to be smaller than the thickness dimension L2 of the upper cover part 5*b*1 has been described. However, the disclosure is not necessarily limited thereto, and a configuration in which the thickness dimension L1 of the lower cover part 5*b*2 and the thickness dimension L2 of the upper cover part 5*b*1 are set to be the same or a configuration in which the thickness dimension L1 of the lower cover part 5*b*2 is formed to be larger than the thickness dimension L2 of the upper cover part 5*b*1 may be adopted.

In the above-described embodiment, a case where the thickness dimension L2 of the upper cover part 5*b*1 is substantially constant in a region facing the upper surface of the outer circumferential part 4*b*3 of the frame bow part 4*b* has been described. However, the disclosure is not necessarily limited thereto, and a configuration in which a portion of the upper cover part 5*b*1 is formed to have a small thickness dimension may be adopted. In this case, it is preferable that a portion of the upper cover part 5*b*1 be formed to have a small thickness dimension on the inner circumferential side of the space S (the edge sensor 7*b*). For example, when a portion of the upper cover part 5*b*1 is formed to have a small thickness dimension in a region which is not bonded to the upper surface of the frame bow part 4*b*, such a thin part extends and is easily elastically deformed.

In the above-described embodiment, a case where the upper cover part 5*b*1 is bonded to the upper surface of the frame bow part 4*b* (the main body 4*b*1) on the inner circumferential side of the outer edge (the space S) of the upper surface of the bent part 4*b*2 has been described. However, the disclosure is not necessarily limited thereto, and a configuration in which the upper cover part 5*b*1 is bonded to the entire upper surface of the frame bow part 4*b* may be adopted.

In the above-described embodiment, a case where the upper surface of the outer circumferential part 4*b*3 and the lower surface (a region in which the projection part 5*b*3 is not formed) of the upper cover part 5*b*1 are parallel to each other has been described. However, the disclosure is not necessarily limited thereto, and a configuration in which the upper surface of the outer circumferential part 4*b*3 and the lower surface of the upper cover part 5*b*1 are not parallel to each other in a region facing the upper surface of the outer circumferential part 4*b*3 (the edge sensor 7*b*) may be adopted. In this case, it is preferable to adopt a configuration in which an interval between the upper surface of the outer circumferential part 4*b*3 and the lower surface of the upper cover part 5*b*1 which face each other becomes wider toward the outer circumferential side in such a region. Thereby, the upper cover part 5*b*1 is elastically deformed by bringing the lower surface of the upper cover part 5*b*1 and the upper surface of the outer circumferential part 4*b*3 into close contact with each other in parallel at the time of hitting, and thus the edge sensor 7*b* can be pressed against the parallel surfaces of the tip end face of the projection part 5*b*3 and the upper surface of the outer circumferential part 4*b*3. Thereby, a hit on the upper cover part 5*b*1 can be appropriately transmitted to the edge sensor 7*b*.

In the above-described embodiment, a case where the bonding part 5*b*4 is hooked by a step formed by the bent part 4*b*2 and the outer circumferential part 4*b*3 has been described. However, the disclosure is not necessarily limited thereto, and a configuration in which a recess is formed in the lower surface of the frame bow part 4*b* and the bonding part 5*b*4 is fitted into the recess may be adopted. Thereby, it is possible to regulate the displacement of the bonding part 5*b*4 toward both the outer circumferential side and the inner circumferential side. That is, in the case of an inner circumferential side of a bonding position between the lower surface of the frame bow part 4*b* and a part (the bonding part 5*b*4) on the inner edge side of the lower cover part 5*b*2, a concave part and a convex part capable of being fitted into each other may be formed in the lower surface of the frame 4 and the upper surface of the cover 5.

In the above-described embodiment, a case where an adhesive is prevented from flowing out to the inner circumferential side of the bonding part 5*b*4 by forming the concave part 5*b*5 in the upper surface of the bonding part 5*b*4 has been described. However, the disclosure is not necessarily limited thereto, and a configuration in which an adhesive is prevented from flowing out by omitting the concave part 5*b*5 (or in addition to the concave part 5*b*5) and providing a concave part in the lower surface of the frame bow part 4*b* may be adopted.

The numerical values mentioned in the above-described embodiment are examples, and other numerical values can be naturally adopted.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic cymbal comprising:

a disk-shaped frame;

a frame bell part which is configured at a center of the frame in a top view;

a bell part sensor which is attached onto the frame bell part in a circumferential direction and detects a hit on the frame bell part, the bell part sensor comprises a first part and a second part; and a cover which covers the frame and the bell part sensor and has a surface formed as a hit surface, wherein the first part has a first C shape and the second part has a second C shape, wherein the first part and the second part of the bell part sensor are separated with a separation in at least a radial direction of the frame bell part, and the separation is arc-shaped, wherein the first part includes a first divided portion forming an opening of the first C shape, and the second part includes a second divided portion forming an opening of the second C shape, wherein the first divided portion and the second divided portion are configured to suppress an erroneous detection of a hit on the frame bell part.

2. The electronic cymbal according to claim 1, wherein the frame bell part is configured such that at least a portion provided with the bell part sensor is formed in a conical shape.

3. The electronic cymbal according to claim 1, wherein a connection part connecting adjacent parts of the bell part sensor to each other is configured in the bell part sensor.

4. The electronic cymbal according to claim 1, wherein a cover bell part is configured at a position corresponding to the frame bell part in the cover, and a pressing part having a projection shape is configured at a position facing the bell part sensor on a rear surface of the cover bell part.

5. The electronic cymbal according to claim 4, wherein a surface of the cover bell part is formed in a hemispherical shape which is convex upward, and a facing surface facing the bell part sensor in the pressing part is formed to match a shape of the frame bell part at a position where the bell part sensor is provided.

6. The electronic cymbal according to claim 4, wherein a gap is formed between the pressing part of the cover and the bell part sensor.

7. The electronic cymbal according to claim 6, wherein an upper limit of the gap is set to 0.8 mm.

8. The electronic cymbal according to claim 4, wherein an engagement part is configured on an inner circumferential side of the cover bell part, and an inner circumferential side of the frame is hooked on the engagement part to engage the cover with the frame.

9. The electronic cymbal according to claim 4, wherein a recess having a U shape in a cross-sectional view is formed at a position on an inner circumferential side of the pressing part in the cover bell part.

10. The electronic cymbal according to claim 4, wherein an outer circumferential side of the frame which is more outside than the frame bell part is a frame bow part, and the frame bow part comprises a main body that gently inclines downward from an outer edge of the frame bell part toward the outer circumferential side of the frame, a bent part that is bent downward from an outer edge of the main body, and an outer circumferential part that protrudes from a lower end side of the bent part toward the outer circumferential side of the frame, and is formed in a disk shape.

11. The electronic cymbal according to claim 10, further comprising:

an edge sensor, wherein a space is configured by an upper surface of the outer circumferential part of the frame bow part and the cover, and the edge sensor is attached on the upper surface of the outer circumferential part of the frame bow part and accommodated in the space.

12. The electronic cymbal according to claim 1, wherein the first part of the bell part sensor is an inner circumferential sensor forming an inner circumferential side of the bell part sensor, and the second part of the bell part sensor is an outer circumferential sensor forming an outer circumferential side of the bell part sensor, and the inner circumferential sensor and the outer circumferential sensor are separated in a radial direction of the bell part sensor.

13. The electronic cymbal according to claim 12, wherein the bell part sensor further comprises a connection part that connects an outer circumferential side of the inner circumferential sensor and an inner circumferential side of the outer circumferential sensor to each other.

14. The electronic cymbal according to claim 13, wherein the connection part is provided at both ends in circumferential directions of the inner circumferential sensor and the outer circumferential sensor and a substantially middle position in the circumferential directions of the inner circumferential sensor and the outer circumferential sensor.

15. A bell part sensor installation method, which is a method of providing a bell part sensor in a frame bell part in an electronic cymbal comprising a disk-shaped frame, a frame bell part which is formed at a center of the frame in a top view, and a bell part sensor which is attached onto the frame bell part in a circumferential direction and detects a hit on the frame bell part, the bell part sensor installation method comprising:

separating the bell part sensor with a separation in at least a radial direction of the frame bell part, and the separation is arc-shaped, and providing a first part sensor and a second part sensor of the bell part sensor with the separation, wherein the first part sensor has a first C shape and the second part sensor has a second C shape, wherein the first part sensor includes a first divided portion forming an opening of the first C shape, and the second part sensor includes a second divided portion forming an opening of the second C shape, wherein the first divided portion and the second divided portion are configured to suppress an erroneous detection of a hit on the frame bell part.

16. The bell part sensor installation method according to claim 15, wherein the first part of the bell part sensor is an inner circumferential sensor on an inner circumferential side of the bell part sensor, and the second part of the bell part sensor is an outer circumferential sensor on an outer circumferential side of the bell part sensor.

17. The bell part sensor installation method according to claim 16, comprising connecting the bell part sensor at an outer circumferential side of the inner circumferential sensor and an inner circumferential side of the outer circumferential sensor to each other.

18. The bell part sensor installation method according to claim 17, wherein connecting the bell part sensor comprising connecting both ends in circumferential directions of the inner circumferential sensor and the outer circumferential sensor and a substantially middle position in the circumferential directions of the inner circumferential sensor and the outer circumferential sensor to each other.

19. The bell part sensor installation method according to claim 15, wherein the frame bell part is configured such that at least a portion provided with the bell part sensor is formed in a conical shape.

* * * * *